United States Patent [19]

Klaus et al.

[11] 4,125,340

[45] Nov. 14, 1978

[54] TRAFFICABLE SURFACE FOR MECHANICAL PARKING APPARATUS, RAMPS, LIFTING PLATFORMS OR THE LIKE

[76] Inventors: Kaspar Klaus, Dr.-Berndl-Str. 5, 8940 Memmingen; Fritz Zepp, 7951 Rot a. d. Rot, both of Fed. Rep. of Germany

[21] Appl. No.: 766,197

[22] Filed: Feb. 7, 1977

[30] Foreign Application Priority Data

Feb. 7, 1976 [DE] Fed. Rep. of Germany ..... 2604882

[51] Int. Cl.[2] ..... E01C 5/16

[52] U.S. Cl. ..... 404/35; 52/588

[58] Field of Search ..... 404/35, 41, 40, 34; 52/588

[56] References Cited

U.S. PATENT DOCUMENTS

| | | | |
|---|---|---|---|
| 2,007,354 | 7/1935 | Vass | 52/588 |
| 2,180,504 | 11/1939 | Bradfield | 52/588 |
| 3,085,666 | 4/1963 | Lydard | 52/588 X |
| 3,143,939 | 8/1964 | Gregoire | 404/35 |
| 3,524,292 | 8/1970 | Bottom | 52/588 X |
| 3,606,718 | 9/1971 | Curran | 52/588 X |
| 3,608,267 | 9/1971 | Curran | 52/588 X |
| 3,733,767 | 5/1973 | Craik | 52/588 X |
| 3,841,776 | 10/1974 | Klaus | 404/41 |

*Primary Examiner*—Nile C. Byers
*Attorney, Agent, or Firm*—Holman & Stern

[57] ABSTRACT

A vehicle-receiving structure which is made up of a series of side-by-side supports each having a down-turned leg at each side for interfitment and coupling with the corresponding leg of the next-adjacent support, each such leg being made from sheet metal which is cranked through a right-angle at least three times along its depth. The outer end of the lowest member of the cranked limbs may be flanged upwards to form a channel to accommodate an abutment element between the internested legs of the adjacent supports.

7 Claims, 4 Drawing Figures

TRAFFICABLE SURFACE FOR MECHANICAL PARKING APPARATUS, RAMPS, LIFTING PLATFORMS OR THE LIKE

BACKGROUND OF THE INVENTION

The invention relates to a vehicle-accessible surface for mechanical parking devices, ramps, lifting platforms or the like. In particular it is concerned with surfaces of this kind which comprise a plurality of adjoining intercoupled substantially like supports made of sheet metal of substantially uniform wall thickness and each including a load-bearing supporting surface with downturned first and second side parts the first of which is of greater overall depth than the second side part, whereby the first side part of one support can engage below the second side part of an adjacent support, and said first and second side parts being cranked to provide surfaces which are respectively parallel to and at right angles to the load-bearing supporting surface for nesting interengagement with the side parts of adjacent supports, the improvement wherein each of the first and second side parts comprises four adjacent surface strips, namely a first strip at right angles to the load-bearing surface, a second strip at right angles to the first strip, a third strip at right angles to the load-bearing surface, and a fourth strip parallel to the load-bearing surface, each of these strips bearing directly against the corresponding strip of the side part of the intercoupled next support.

In supports of the kind set forth above it is of importance that the adjacent supports mutually reinforce one another under the maximum strain applied thereto in use, so that the load imposed on one support can be distributed to an optimum plurality of other such supports.

SUMMARY OF THE INVENTION

It is an object of the present invention to develop a vehicle-accessible surface of this kind and in such a way that the surface can be fabricated and can be assembled in as simple a way as possible.

To meet this object, the present invention provides an arrangement wherein each of the first and second side parts comprises four adjacent surface strips, namely a first strip at right angles to the load-bearing surface, a second strip at right angles to the first strip, a third strip at right angles to the load-bearing surface, and a fourth strip parallel to the load-bearing surface, each of these strips bearing directly against the corresponding strip of the side part of the intercoupled next support.

The invention represents a substantial simplification. The downwardly-directed side parts consist of very few surfaces, thereby simplifying the construction. The dimensional accuracy is also improved thereby enabling the parts of adjacent side-by-side supports to be interengaged accurately and practically without play between them. This further improves the mutual supporting effect between the surfaces.

Since the number of adjoining surface strips is small in pursuance of the invention, these surface strips, and particularly those which extend parallel to the supporting surface, can be made of a wide dimension. This reduces the surface pressures and wear.

The interengaging side parts of the supports may be provided with an upturned flange so as to form a channel which is important in preventing leaking water falling in drops so that a plurality of accessible surfaces of this type, for example, in the case of lifting platforms and even parking devices, can be arranged one above another without the vehicles on the lowermost surface being exposed to leaking water.

In a further development of this feature, the channel is used to accommodate at least one spacing and abutment element which precludes relative movement between adjacent and interengaged supports.

The channel referred to above may be further exploited in this invention. Thus the comparatively large-dimensioned channel may accommodate an abutment or spacing element which can be made very simply and also assembled in a very simple fashion, thereby providing for very easy mutual fixing of adjacent surfaces. As a result, the use of other fastening means for securing a support to beams carrying the same can be dispensed with or reduced in number without impairing the required safe mutual engagement between the adjacent supports.

In a further development of the invention, the spacing between the upturned flange and said first strip is slightly more than the width of the fourth strip of the other of said side parts.

This construction caters for a simple telescoping of adjacent supports. This avoids the need for rocking of the supports for assembly, and these supports only have to be interengaged in a telescopic manner. It will be apparent that the sliding interengagement represents a substantial saving in workmen's time in relation to other known methods of assembly. The liability to mutual movement between the supports, which might seem to be incorrect by their crude interengagement is entirely eliminated by the spacer elements.

These spacer elements, used in accordance with the invention, may be of a rigid nature or can be resiliently yielding. In the case of the latter, the resilience caters for the required incorporation of the elements in the already-assembled parts. Where required, rigid spacer elements can be fixed at the required places by usual fastening means, although fastening by cementing or other plastic media is also feasible.

This is made possible by the fact that the fixing in position of the spacer elements does not call for any opposing force to be overcome.

A particularly useful arrangement is found possible where the resilient spacing element is made non-resilient in the locking direction between the supports. This arrangement is preferred to the resilient function in the locking direction.

BRIEF DESCRIPTION OF DRAWINGS

This and further features of the invention are disclosed in the following description of an embodiment thereof diagrammatically illustrated in the accompanying drawings, in which.

DETAILED DESCRIPTION OF PREFERRED EMBODIMENTS

Figures 1, 2:
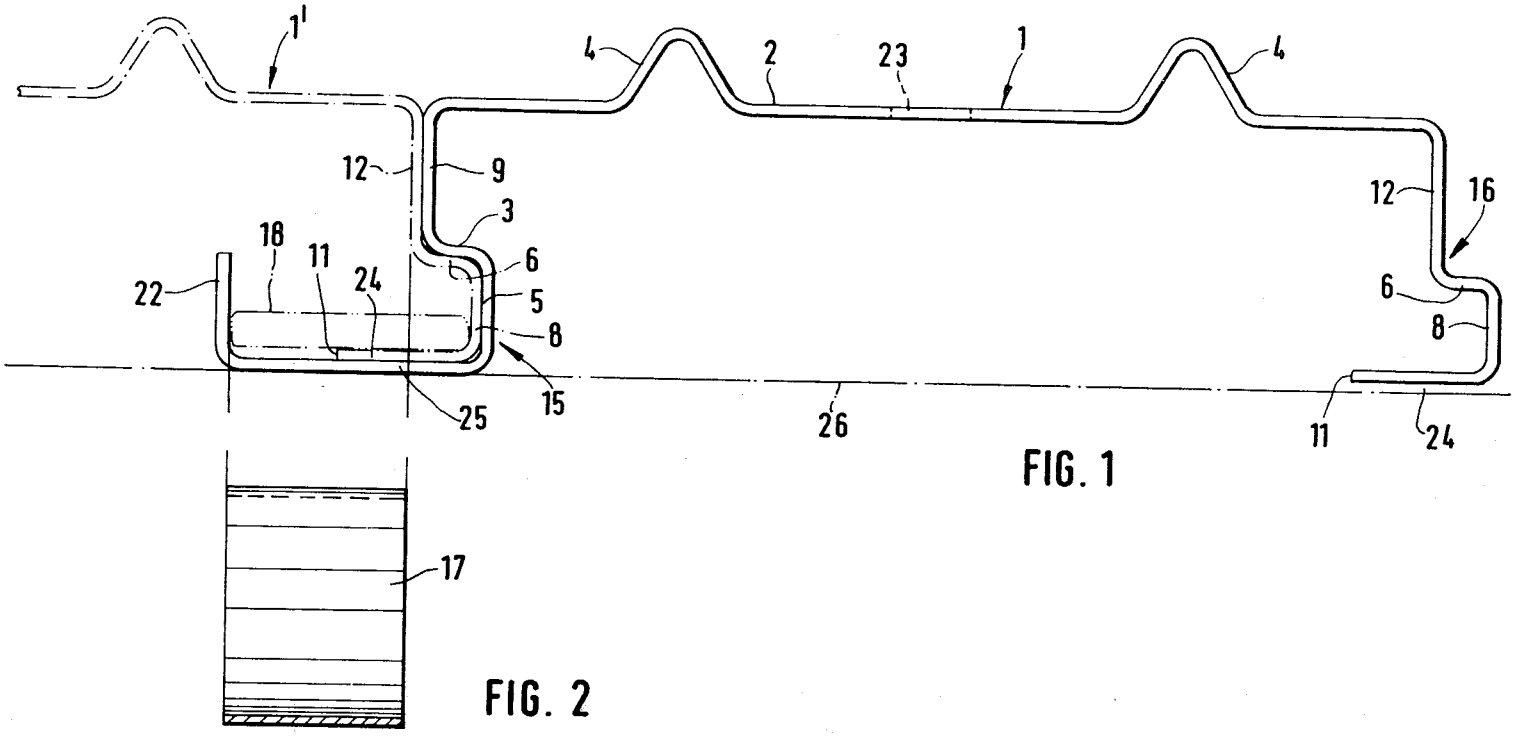
FIG. 1 is an end view of a support from which the accessible surface in accordance with the invention is constructed.
FIG. 2 is a detail of the invention in cross section.

A support 1 is made from a blank of sheet metal which is appropriately flanged and bent. All parts of the support 1 are then of substantially the same wall thickness. An upper wall part 2 of the support 1 cooperates with the wall parts of other supports to form the vehicle-accessible surface. An adjacent support 1' is indicated in chain dotted lines in FIG. 1. The upper wall part 2 is formed with ribs 4 which increases the frictional effect of the accessible surface.

The metal sheet of each support is bent to provide two downwardly-directed shaped side wall parts 15 and 16. A part 15 consists of the metal strip 9 which extends at right angles to the wall part 2 and is adjoined by a surface strip 3 parallel to the wall part 2. Adjoining the strip 3 in turn is a strip 5 which is parallel to the strip 9 and is connected to a strip 25 the margin of which is bent upwards to form a flange 22.

The other shaped part 16 likewise is made up of strips 12, 6, 8 and 24 in that order. The edge of the strip 24 is designated 11.

While the strips 3 and 6 are of substantially like dimensions, the strip 12 is wider than strip 9, by about the wall thickness of the sheet, and the strip 8 is correspondingly narrower than the strip 5 so that the two supports 1 and 1' can be interengaged in the manner illustrated in FIG. 1.

The strips 25 are, for example, mounted on beams which have been designated by chain dotted lines 26. Holes 23 may be provided in the wall part 2 to enable the individual supports to be connected to the beam by screws or other means.

Since the beams have a limited width it is of advantage for the marginal strips 25 to be comparatively wide to avoid deformation at the supporting part. On the other hand, the marginal strips 24 which are supported on the marginal strips 25 can be narrower to leave a gap between the edge 11 and the flange 22 of the interfitted support.

With an erected support loaded, the loading forces are conducted in the vicinity of the shaped part 15 partially directly through the marginal strip 25 to the beam, but to a partial extent there is a transmission of force through the strip 3 to the strip 6 and thereby to the other shaped part 16. By this means, the shaped part of the adjacent support is also loaded.

On the other hand, the marginal strip 24 of the shaped part 16 is supported on the strip 25 whereby the neighboring shaped part 15 bears part of the load applied to the part 16.

Since the strips 24 are substantially narrower than the gap between the flange 22 and the junction between the strip 9 and the strip 3, there is no difficulty in inserting the shaped part 16 into the shaped part 15.

In the interengaged condition a spacing element, for example in the form of a flat iron bar 18, can be inserted as indicated in FIG. 1. This flat iron bar prohibits any movement of separation between the flange 22 and the strip 8 of the interfitting supports 1 and 1'.

Instead of the spacer element 18, use may be made of a spacer element 17 as illustrated in FIG. 2. The width of this spacer element, which may for example be an undulated leaf spring, is such as to provide a locking engagement between the flange 22 and the lower end of the strip 12 of the adjacent support 1'. The spacer element 17 can be introduced after preliminary deformation and the spring action will hold the spacer element in the required position.

At the same part at which the spacer element 17 is used, a non-resilient, rigid spacer element can be located and have a similar effect to the spacer element 18.

Figure 4:
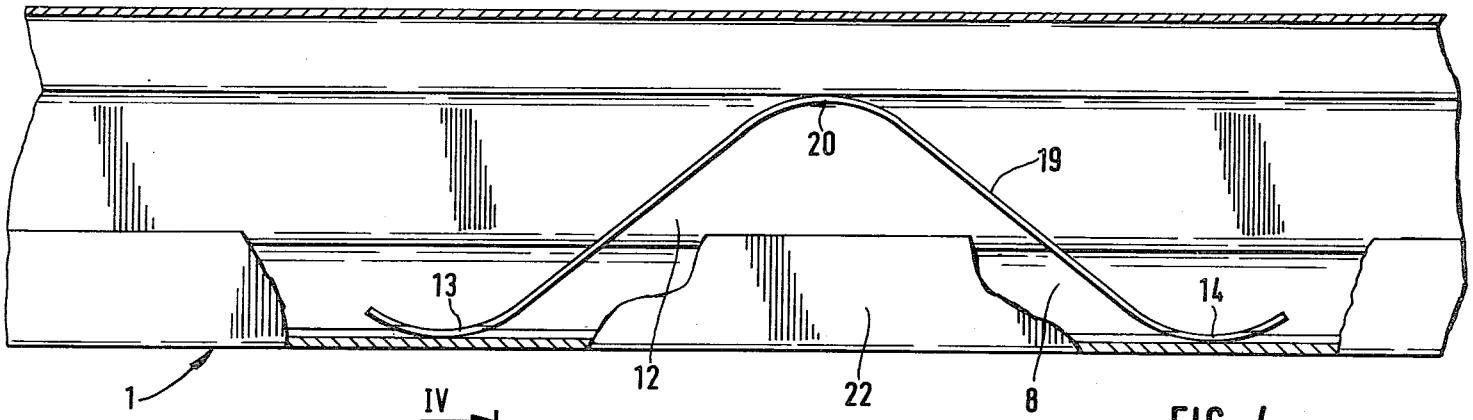
FIG. 4 is a part sectional view taken along line IV—IV of FIG. 3.
Figure 3:
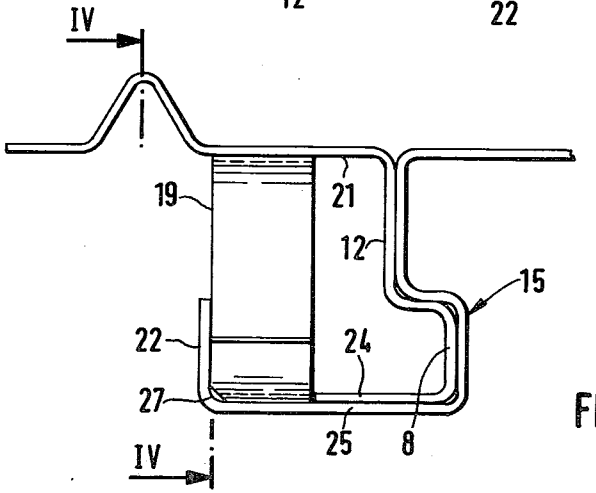
FIG. 3 is an end view of part of a support in accordance with another embodiment of the invention.

The use of another form of spacer element 19 is illustrated in FIGS. 3 and 4. This element 19 is in the form of a leaf spring with arcuate parts 13, 14 and 20. The arcuate parts 13 and 14 are applied against the upper face of the marginal strip 25, while the part 20 bears against the lower face 21 of the wall part 2. The radius between the marginal strip 25 and the flange 22 is compensated by a small chamfer 27.

In the embodiments of the support 1 illustrated in the drawing, rounded parts are in each case provided between adjoining strips of the shaped parts 15 and 16 at right angles to one another. Where these rounded parts are of large radius of curvature, the widths of the strips are reduced and in particular the surface strip 3 is defined only by a transition between one and the other radius of curvature. Similar variants of the invention are usable because further and adequate surfaces are available for the transfer of forces and a comparatively roomy conduit is provided by the surrounding profiled parts 15 which gives a wide flange for transfer of forces and also leaves adequate space for the relevant spacing element. Moreover in such constructions no significant spreading ever occurs during use.

I claim:

1. In a vehicle-accessible surface for mechanical parking devices, ramps, lifting platforms and the like comprising a plurality of adjoining intercoupled substantially like supports made of sheet metal of substantially uniform wall thickness and each including a load-bearing supporting surface with downturned first and second side parts the first of which is of greater overall depth than the second side part, whereby the first side part of one support can engage below the second side part of an adjacent support, and said first and second side parts being cranked to provide surfaces which are respectively parallel to and at right angles to the load-bearing supporting surface for nesting interengagement with the side parts of adjacent supports, the improvement wherein each of the first and second side parts comprises four adjacent surface strips consisting of a first strip at right angles to the load-bearing surface, a second strip at right angles to the first strip, a third strip at right angles to the load-bearing surface, and a fourth strip parallel to the load-bearing surface, each of these strips bearing directly against the corresponding strip of the side part of the intercoupled adjacent support, the outermost and fourth strip of one of said first and second side parts is extended by an upturned flange forming a channel at the lower end of the side strip concerned, the extended fourth strip having a greater width than the fourth strip on the other side part and at least one spacing element resiliently engaged between the foreshortened fourth strip of one support and the underside of the load-bearing surface of this support, the spacing element having a width which constitutes a rigid abutment between said upturned flange of the other support and the said first strip of the one support.

2. The vehicle-accessible surface according to claim 1 in which said spacing element is of a springy character.

3. The vehicle-accessible surface according to claim 1, in which the said spacing element is of a springy character but is inelastic in the direction of interlocking between the adjacent supports.

4. The vehicle-accessible surface according to claim 1, in which the spacing between said upturned flange and said first strip is slightly more than the width of the fourth strip of the other of said side parts.

5. The vehicle-accessible surface according to claim 1, in which said spacing element is resiliently engaged between said extended fourth strip and the underside of the load-bearing surface of the adjacent support and forms a rigid abutment between the foreshortened fourth strip of the one support and the upturned flange of said adjacent support.

6. The vehicle-accessible surface according to claim 1, in which said spacing element is engaged between said upturned flange of one of said supports and the third strip of the other of said supports.

7. The vehicle-accessible surface according to claim 1, in which the spacing element is a symmetrically-shaped leaf spring.

* * * * *